US006662778B2

(12) United States Patent
Leman

(10) Patent No.: US 6,662,778 B2
(45) Date of Patent: Dec. 16, 2003

(54) ENGINE COMPRESSION RELEASE BRAKE SYSTEM AND METHOD FOR OPERATING THE SAME

(75) Inventor: Scott A. Leman, Eureka, IL (US)

(73) Assignee: Caterpillar Inc, Peoria, IL (US)

( * ) Notice: Subject to any disclaimer, the term of this patent is extended or adjusted under 35 U.S.C. 154(b) by 286 days.

(21) Appl. No.: 09/909,551

(22) Filed: Jul. 20, 2001

(65) Prior Publication Data

US 2003/0015172 A1 Jan. 23, 2003

(51) Int. Cl.[7] ..... G06G 7/70
(52) U.S. Cl. ..... 123/322; 701/115
(58) Field of Search ..... 123/321, 322, 123/320, 90.15; 701/102, 115

(56) References Cited

U.S. PATENT DOCUMENTS

| | | | | |
|---|---|---|---|---|
| 4,741,307 A | | 5/1988 | Meneely | |
| 5,012,778 A | | 5/1991 | Pitzi | |
| 5,357,926 A | | 10/1994 | Hu | |
| 5,647,317 A | * | 7/1997 | Weisman et al. | 123/436 |
| 6,246,948 B1 | * | 6/2001 | Thakker | 701/93 |
| 6,321,717 B1 | * | 11/2001 | Faletti | 123/321 |
| 2003/0019469 A1 | * | 1/2003 | Mickiewicz et al. | 123/321 |

FOREIGN PATENT DOCUMENTS

| | | |
|---|---|---|
| DE | 295 20 819 U1 | 5/1996 |
| EP | 0 790 592 A1 | 8/1997 |
| GB | 2 353 647 A | 2/2001 |

* cited by examiner

*Primary Examiner*—Henry C. Yuen
*Assistant Examiner*—Arnold Castro
(74) *Attorney, Agent, or Firm*—Mike Huber; Steve L Noe

(57) ABSTRACT

A compression release brake system for an internal combustion engine is selectively operable in different modes that provide lower levels of noise emissions at lower levels of vehicle retarding. Lower noise levels are achieved by advancing or otherwise modulating the timing of brake events, thereby reducing cylinder pressure during release and thus reducing noise levels. A system is provided on board the vehicle to determine when the vehicle is operating in a noise restricted region and automatically switch to a braking mode that produces lower, acceptable levels of noise emissions. GPS or other sensors may be used to determine when the vehicle is operating in a restricted region.

26 Claims, 4 Drawing Sheets

ENGINE COMPRESSION RELEASE BRAKE SYSTEM AND METHOD FOR OPERATING THE SAME

TECHNICAL FIELD

This invention relates to a compression release brake system for an internal combustion engine and a method of operating the same to achieve desired noise emission levels.

BACKGROUND ART

Engine compression release brakes are well known for providing retarding of vehicles without activation of the vehicle's service brakes. Examples of known engine compression release brakes are shown in U.S. Pat. Nos. 5,012,778 to Pitzi and 4,741,307 to Meneeley. In general, traditional engine compression release brakes provide retarding by absorbing energy as a result of compressing intake air in the engine's combustion chamber. The engine's exhaust valves are opened near the end of the normal compression stroke, thereby preventing energy from being imputed back into the drive train. When the exhaust valves are opened, the pressure in the engine cylinder is released or "blown down", which produces a high level of noise emissions through the engine exhaust system.

The aforementioned compression release brake systems are routinely used on over-the-road or on-highway vehicles, such as delivery truck and semi-tractors that regularly operate in both rural and urban regions. Many jurisdictions have instituted noise level restrictions, especially in residential areas, and traditional compression release brake systems typically produce noise levels that exceed the maximum noise levels permitted by law in many geographic regions. Consequently, vehicle operators are routinely prohibited from operating compression release brakes when operating in noise restricted regions. As a result, the operator must utilize the vehicle's services brakes to retard or slow the vehicle in cases where a compression release brake could be advantageously used to avoid wear on the service brakes.

Traditional engine compression release brakes, such as those commercially available from Jacobs Manufacturing Company for example, are able to modulate the applied retarding force by selectively operating brake cycles on less than all of the engine cylinders. For example, in a six cylinder engine, brake systems are typically installed such that one portion of the brake system controls braking on one cylinder, another portion of the brake system controls braking on two cylinder together, and a third portion of the system controls braking on the remaining three cylinders. As a result, the vehicle operator can select among six discrete levels of braking by activating one to six of the cylinders. However, such modulation of the brake systems does not significantly alter the noise emission level produced by brake operation, but instead only changes the frequency of noise emissions and/or the cadence the noise emissions. This is due to the fact that resulting noise emissions correspond to the cylinder pressure at the time of pressure release, which is in turn tied to the timing of the pressure release event, which is in turn tied to the fixed shape of the cam that operates a traditional compression release brake. Although de minimis noise reduction may be achieved in traditional systems because lower braking levels produce lower turbo boost and thereby reduce cylinder pressure at the time of release, significantly reduced levels of noise emissions are not achievable in traditional systems even when operating at lower levels of braking or retarding.

Another attempt to reduce noise is illustrated in U.S. Pat. No. 5,357,926 to Hu. In this patent, noise is reduced when the vehicle operator electrically adjusts the "lash" of the engine brake. "Lash" is the "at rest" clearance between the engine brake slave piston and the engine exhaust valve mechanism operated on by the slave piston to produce braking. By reducing the "lash", the timing of the braking event is advanced slightly, thereby reducing the cylinder pressure at "blow down." Unfortunately, this approach is not automatic and requires the driver to recognize that he or she is in a noise restricted area and manually change the lash. Additionally, this design only provides one level of adjustment, even though jurisdiction may have varying degrees of noise restrictions. This system also increases the number of components in the vehicle and increases cost. Finally, because the "lash" is manually changed, the braking system is not capable of automatically providing additional braking power in an emergency, when it would otherwise be desirable to "ignore" noise restrictions for overriding safety concerns.

This invention is directed to overcoming one or more of the problems identified above.

DISCLOSURE OF THE INVENTION

The present invention includes a method for operating a vehicle having an engine compression release brake, comprising: operating the engine compression release brake in a first mode producing a first level of noise emissions; determining that the vehicle is operating in a noise restricted geographic region; and in response to the determining step, automatically operating the engine compression release brake in a second mode producing a second level of noise emissions lower than the first level of noise emissions.

BEST MODE FOR CARRYING OUT THE INVENTION

Figure 1:
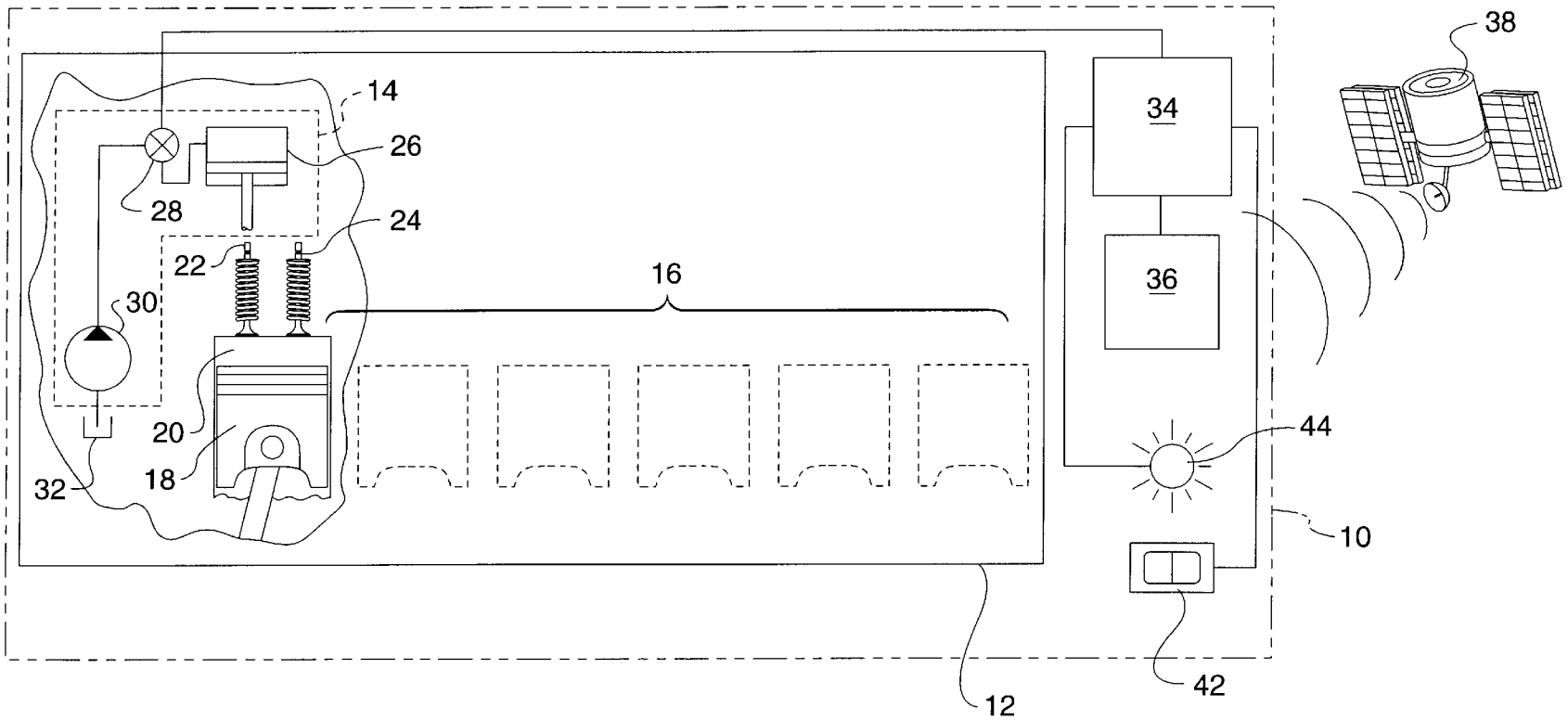
FIG. 1 diagrammatically illustrates a vehicle having an internal combustion engine equipped with a compression release brake system in accordance with a first embodiment of this invention.

FIG. 1 diagrammatically illustrates a vehicle 10 having an internal combustion engine 12 equipped with a compression release brake system 14 in accordance with this invention. The vehicle 10 may be an on-highway vehicle, such as a Class 6,7 or 8 on-highway truck, or may be an off-highway vehicle, such as an earthmoving machine or other piece of construction/mining equipment. The engine 12 is a conventional reciprocating piston engine having one or more cylinders 16 in which a piston 18 reciprocates. The illustrated engine 12 includes six cylinders, although this invention is equally applicable to engines having more or less than six cylinders.

Each cylinder 16 and corresponding piston 18 cooperate to define a combustion chamber 20 having one or more conventional intake valves 22 and exhaust valves 24. The valves 22 and 24 may be operated in several ways that are well known in the art. First, the valves 22 and 24 can be cam operated. Second, they could be operated in a "camless" manner, using electromagnetic or electrohydraulic actuators or the like. Third, a hybrid, cam and camless, method could be used in which the valves are actuated with a cam and alternative "camless" type actuators. One or more—and preferably all—of the cylinders 16 are provided with a brake actuator, generally designated 26, forming part of the engine compression release brake system 14. Each brake actuator 26 is preferably controllable to open one or more exhaust valves 24 with timing independent of engine speed. It should be noted that the system could also implement a separate, dedicated retarder valve as opposed to using one of the exhaust 24 or intake 22 valves.

FIG. 1 diagrammatically illustrates a compression brake system 14. A variety of compression brake systems are known in the art and the present invention would work well with all systems capable of changing timing or otherwise selecting a mode of operation that reduces noise at blow down. Greater details on how compression brake systems are structured and operate can be found in commonly owned U.S. patent application Ser. Nos. 9/742730 and 9/441854, as well as U.S. Pat. Nos. 5,012,778 to Pitzi and 5,357,926 to HU. As generally shown in FIG. 1, the compression brake system 14 comprises a brake actuator 26, an electronic control valve 28, a high pressure pump 30, and a source of hydraulic fluid 32. The pump 30 has a fluid line that connects it to the low pressure source of hydraulic fluid, which is preferably lubricating fluid, such as oil, but could be a variety of other fluids including fuel or transmission fluid. The pump 30 then provides high pressure fluid to the electronic control valve 28. The valve 28 is preferably a 3-way poppet or spool valve operated by solenoid or piezo actuator but could have other configurations. The electronic control valve 28 is controlled by electronic control unit (ECU) 34. When the electronic control valve 28 is actuated, high pressure fluid actuates a piston in the brake actuator 26 which, in turn, opens the exhaust valve 24.

Figure 4:
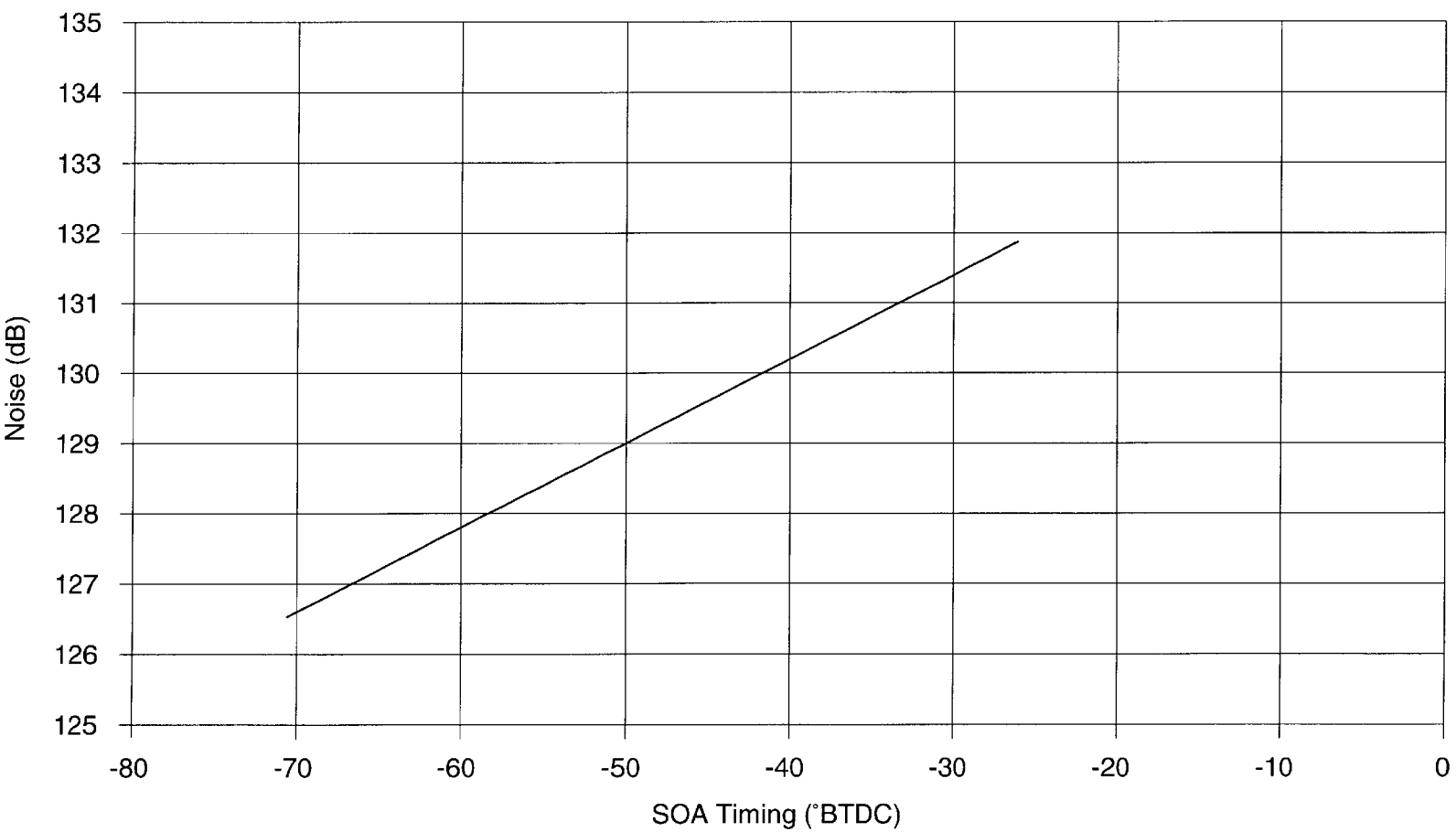
FIGS. 4 and 5 are graphs illustrating noise emission and retarding torque, respectively, based on timing of a compression release event in accordance with this invention.
Figure 5:
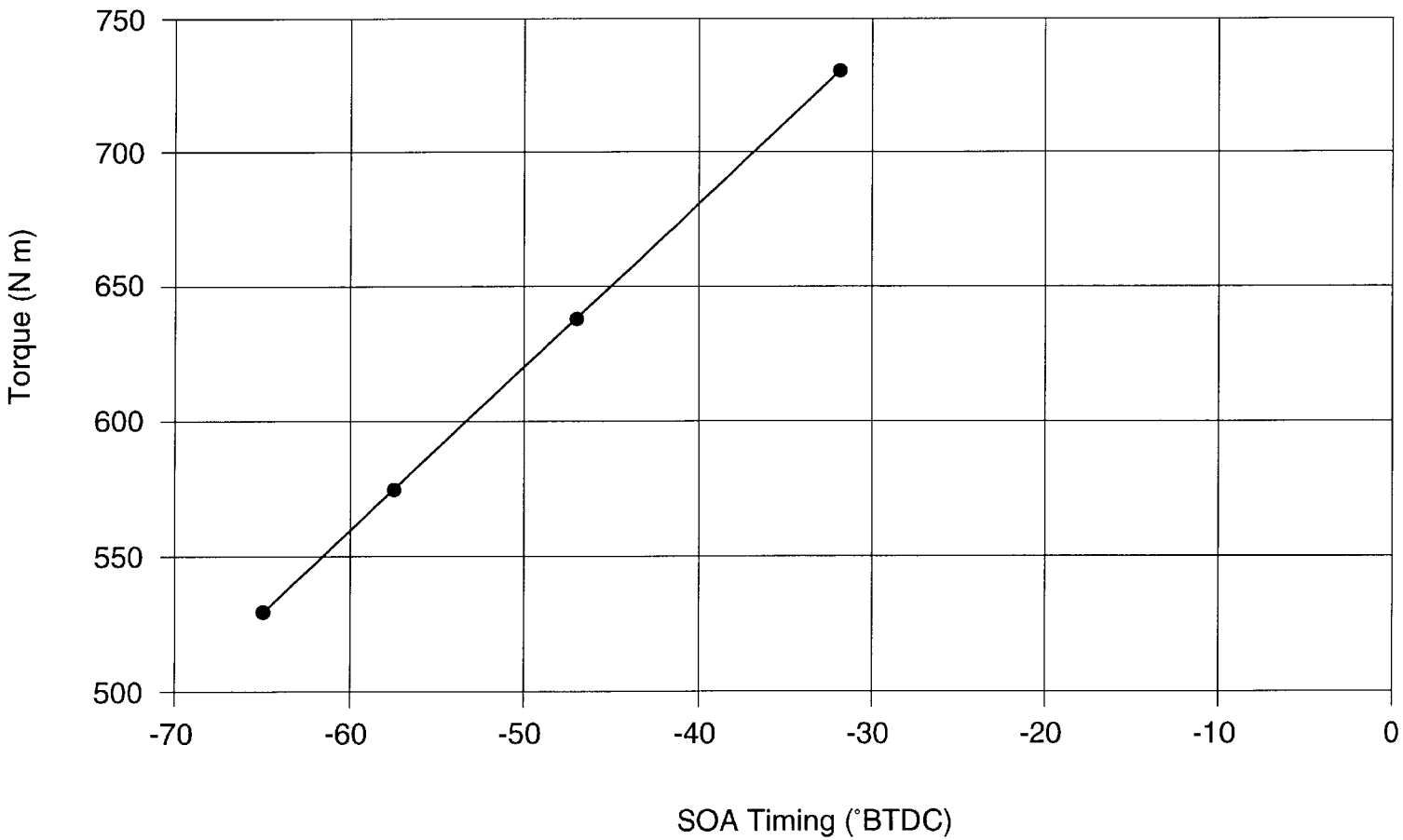

Braking is accomplished by opening a cylinder valve, usually the exhaust valve 24, when the piston is near top dead center (TDC) during the compression stroke. Specifically, during the compression stroke, the piston 18 works to compress air in the combustion chamber 20. When the exhaust valve is opened near TDC, the compressed air is vented or "blown down" and thus no energy is imported back into the drive train during the subsequent turnaround stroke of the piston (i.e. the normal "power stroke"). This has a retarding effect on the engine as a whole, helping to slow the vehicle 10. The closer the piston 18 is to TDC, the more work the piston has performed before the cylinder pressure is blown down and consequently, the more braking power that is generated. Unfortunately, the closer the exhaust valve 24 is to TDC when it is opened, the more noise emissions that are created. FIGS. 4 and 5 illustrate representative noise emissions and retarding torque based on the timing of the braking event.

When the desired braking event is accomplished, the electronic control valve is deactivated, stopping high pressure fluid from acting on the brake actuator 26 and venting the high pressure fluid present in the brake actuator 26, allowing exhaust valve 24 to return to it's closed position.

The ECU 34 controls the timing of the braking events by actuating the electronic control valve 28. Depending on when the ECU actuates the control valve 28, various levels of braking can be obtained with various levels of noise. In particular, it is important to be able to control the noise level of the brakes. In many urban areas, for example, noise restrictions limit the amount of noise that can be produced by a vehicle. In order to comply with the laws in these noise restricted areas, it is desirable to be able to control the timing of the braking event to reduce noise emissions. According to one aspect of the present invention, the ECU 34 automatically recognizes that the vehicle 10 is in a noise restricted area and adjusts the brake timing accordingly.

Figure 2:
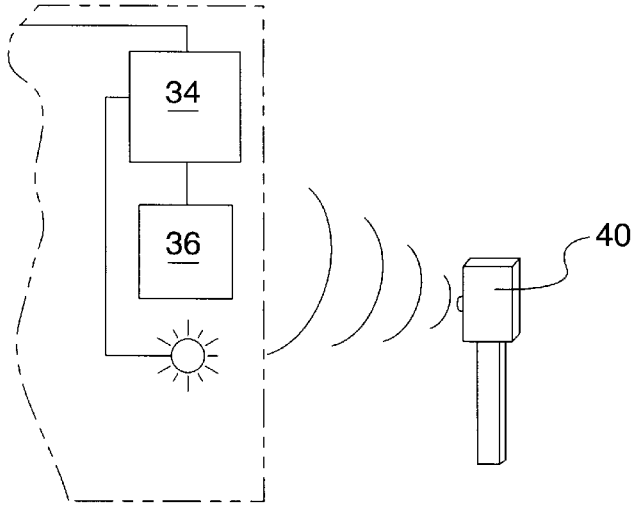
FIG. 2 diagrammatically illustrates a second embodiment of a portion of the compression release brake system shown in FIG. 1.
Figure 3:
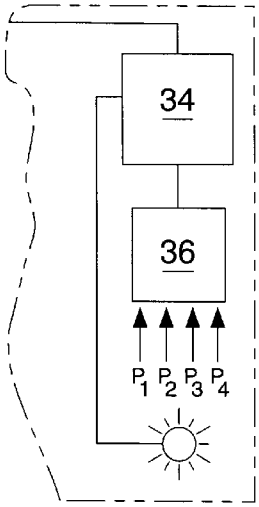
FIG. 3 diagrammatically illustrates a third embodiment of a portion of the compression release brake system shown in FIG. 1.

The ECU 34 communicates with at least one sensor 36 to receive information that allows the ECU 34 to determine that the vehicle 10 is in a noise restricted area. The sensor can receive a variety of information to help the ECU 34 make the proper determination. In FIG. 1, the sensor 36 is illustrated receiving data from a satellite, such as global positioning data from a global positions satellite (GPS) 38. The GPS data would allow the ECU 34 to determine that it was in an urban or other noise restricted area and then adjust the brake timing accordingly. In FIG. 2, the sensor 36 is illustrated receiving data from a land-based transmitter 40. The transmitter 40, could be transmitting a variety of signals including sonic (e.g. RF) and light based (e.g. 1R) signals and could be located near a city limit or wherever noise restrictions took effect. In FIG. 3, the sensor 36 is designed to monitor vehicle 10 parameters, designated as p1–p4, that would indicate that the vehicle 10 is being operated in an urban area and noise levels should be controlled. Specifically, the sensor 36 could monitor a variety of vehicle parameters including vehicle speed, gear selection, and frequency of gear selection and speed changes.

The system illustrated in FIG. 1 also illustrates a manual override switch 42. This would allow the vehicle operator to decide that the ECU 34 should not reduce braking power based upon a signal from the sensor 36. A vehicle operator may want this ability if road conditions are bad or in the case of an emergency where full retarding power is desired. The ECU 34 could also provide an automatic override function. In this case, the sensor 36 could also monitor vehicle parameters, such as brake pedal position, to determine the amount of braking power requested by the operator. The ECU 34 could then determine if an emergency stop was required and automatically provide maximum braking even if the vehicle was in a noise restricted area. The system illustrated in FIG. 1. also illustrates a signal light, 44. The signal light 44 would be controlled by the ECU 34 such that it would be on whenever the vehicle 10 was operating in a noise reduction mode. This would keep the operator informed about the operating conditions of the vehicle 10. As an alternative to or an addition to this visual signal, an audible signal could also be sounded.

Industrial Applicability

The present invention automatically controls compression brake noise by determining when the vehicle 10 is in an urban area or an otherwise noise restricted area. As stated previously, the specific structure of the compression brake system 14 can take a variety of forms as long as it is controllable by the ECU 34. The ECU 34 controls when the timing of the braking events in order to control noise emissions. In the default operating mode, the ECU 34 will provide the maximum amount of braking allowed without regard to noise emissions. However, the ECU 34 can automatically change to a reduced-mode when it receive information from the sensor 36 which indicates that the vehicle 10 is operating in a noise restricted area.

The sensor 36 can be designed to receive information from a variety of sources such as GPS or other satellite land-based transmitter, or vehicle systems. Once the sensor 36 receives information, the ECU 34 processes the information and determines if the vehicle 10 is operating in a noise restricted area. If the vehicle is in a noise restricted area, the ECU 34 alters the compression brake timing and activates a signal such as light 44, to inform the operator that the vehicle is in the reduced noise mode and that less retarding is thus available.

The reduced retarding mode can be turned off manually by the operator by activating the override switch 42. Further the ECU 34 can automatically override the reduced retarding mode if it senses an emergency and the immediate need for full retarding.

Although the presently preferred embodiments of this invention have been described, various other modifications could be made to the illustrated embodiments without operating from the scope of the claims below.

What is claimed is:

1. A method of operating a vehicle in a geographic region mandating a maximum noise level comprising;

operating the vehicle with a compression release brake system capable of automatically determining that the vehicle has entered the geographic region and automatically operating in a noise reduced mode.

2. A method of controlling vehicle noise emissions in a geographic region comprising:

mandating a maximum noise level for a vehicle traveling in the geographic region, and requiring the vehicle that enters the geographic region to be equipped with a compression release brake system capable of automatically determining that the vehicle has entered the geographic region and automatically operating in a noise reduced mode.

3. A engine compression release brake system for an internal combustion engine, comprising:

an engine compression release brake selectively operating an engine in compression release brake mode, said engine compression release brake being operable in a first mode that produces a first level of vehicle retarding and a first level of noise emission corresponding to said first level of vehicle retarding and further being operable in a second mode that produces a second level of vehicle retarding less than said first level of vehicles retarding and a second level of noise emission corresponding to said second level of vehicle retarding, said second level of noise emission being lower than said first level of noise emission; and a controller for automatically selectively operating said engine compression release brake in either said first mode or said second mode.

4. A method of operating a vehicle having an engine compression release brake, comprising:

having an electronic control unit automatically operate engine compression brake in a first mode to produce a first level of vehicle retarding and a first level of noise emissions corresponding to said first level of vehicle retarding; and operating the engine compression brake in a second mode to produce a second level of vehicle retarding less than said first level of vehicle retarding and a second level of noise emissions corresponding to said second level of vehicle retarding, said second level of noise emissions being lower than said first level of noise emissions.

5. A method for operating a vehicle having an engine compression release brake, comprising:

operating the engine compression release brake in a first mode producing a first level of noise emissions;

determining that the vehicle is operating in a noise restricted geographic region; and in response to said determining step, automatically operating the engine compression release brake in a second mode producing a second level of noise emissions lower than said first level of noise emissions.

6. The method of claim 5 further comprising the step of, in response to said determining step, producing a human perceptible signal indicating that the vehicle is operating in a noise restricted geographic region.

7. The method of claim 6 wherein said signal is a audible signal.

8. The method of claim 6 wherein said signal comprises a visual signal.

9. The method of claim 5 further comprising the step of providing a human perceptible signal that said engine compression release brake is being operated in said second mode.

10. The method of claim 5 wherein said determining step comprises:

sensing the geographic location of the vehicle; and determining that said geographic location is within a noise restricted geographic region.

11. The method of claim 10 wherein said sensing step comprises using a global positioning system to determine the geographic location of the vehicle.

12. The method of claim 5 wherein said determining step comprises receiving a signal from a transmitter marking the boundary of said noise restricted geographic regions.

13. The method of claim 12 wherein said signal comprises a sonic signal.

14. The method of claim 12 wherein said signal comprises a light-based signal.

15. The method of claim 5 wherein said determining step comprises:

monitoring at least one vehicle operating parameter indicative of operation is an urban region; and determining that said vehicle is operating in an urban region based on said monitored vehicle operating parameters.

16. The method of claim 15 wherein said at least one operating parameter is selected from the group consisting of vehicle transmission gear selection, vehicle speed, frequency of vehicle transmission gear changes, and frequency and amplitude of vehicle speed changes.

17. An engine compression release brake system for a vehicle, comprising:

an engine compression release brake operable in a first mode producing a first level of noise emissions and a second mode producing a second level of noise emissions lower than said first level of noise emissions;

a sensor for determining that the vehicle is operating in a noise restricted geographic region; and a controller operable in response to said sensor for selectively operating the engine compression release brake in said first mode or said second mode.

18. The engine compression release brake system of claim 17 wherein said sensor senses the geographic location of the vehicle and said controller determines that said sensed geographic location is within a noise restricted geographic region.

19. The engine compression release brake system of claim 17 wherein said sensor comprises a global positioning system sensor.

20. The engine compression release brake system of claim 17 wherein said sensor receives a signal from a transmitter marking the boundary of said noise restricted geographic regions.

21. The engine compression release brake systems of claim 20 wherein said signal comprises a sonic signal.

22. The engine compression release brake system of claim 20 wherein said signal comprises a light-based signal.

23. The engine compression release brake system of claim 17 wherein said sensor monitors at least one vehicle operating parameter indicative of operation in an urban region, and wherein said controller cooperates with said sensor to determine that said vehicle is operating in an urban region based on said monitored vehicle operating parameters.

24. The method of claim 15 wherein said at least one operating parameter is selected from the group consisting of vehicle transmission gear selection, vehicle speed, frequency of vehicle transmission gear changes, and frequency and amplitude of vehicle speed changes.

25. The engine compression release brake system of claim 17 further comprising a manually operable override switch for selecting said first mode regardless of determinations by said sensor that said vehicle is operating in a noise restricted geographic region.

26. The engine compression release brake system of claim 17 wherein a second sensor monitors at least one vehicle operating parameter indicative of an emergency stop, and wherein said controller cooperates with said sensor to determine that that an emergency stop is required based upon said monitored vehicle parameters and said controller automatically overrides said second mode.

* * * * *